US006789549B2

(12) United States Patent
Johnson

(10) Patent No.: US 6,789,549 B2
(45) Date of Patent: Sep. 14, 2004

(54) APPARATUS FOR MANAGEMENT OF HAIR

(76) Inventor: John E. Johnson, 12620 Britton Dr., Cleveland, OH (US) 44120

( * ) Notice: Subject to any disclaimer, the term of this patent is extended or adjusted under 35 U.S.C. 154(b) by 0 days.

(21) Appl. No.: 10/190,877

(22) Filed: Jul. 8, 2002

(65) Prior Publication Data

US 2004/0003823 A1 Jan. 8, 2004

(51) Int. Cl.[7] ..... A45D 24/16; A45D 24/04
(52) U.S. Cl. ..... 132/120; 132/126
(58) Field of Search ..... 132/120, 219, 132/126, 148, 123, 150, 124, 111; 15/167.1, 176, 145, 194

(56) References Cited

U.S. PATENT DOCUMENTS

| | | | | | |
|---|---|---|---|---|---|
| 202,161 | A | * | 4/1878 | Finley | 132/120 |
| 288,534 | A | | 11/1883 | Wilkerson | |
| 525,337 | A | * | 9/1894 | Cooper | 132/219 |
| 1,206,679 | A | * | 11/1916 | Cummings | 132/219 |
| 2,148,927 | A | * | 2/1939 | Conway | 132/148 |
| 2,160,618 | A | | 5/1939 | Kreutzig | |
| 2,181,448 | A | * | 11/1939 | Behr | 132/120 |
| 2,261,747 | A | | 11/1941 | Vegh | |
| 2,446,086 | A | | 7/1948 | Hermans | |
| 2,450,344 | A | | 9/1948 | Jung | |
| 3,083,715 | A | * | 4/1963 | Trabish | 132/150 |
| 3,084,700 | A | * | 4/1963 | Fischer et al. | 132/150 |
| 5,007,442 | A | * | 4/1991 | Hirzel | 132/218 |
| 5,449,006 | A | * | 9/1995 | Hogan et al. | 132/112 |
| 5,960,745 | A | * | 10/1999 | Boyland | 119/613 |
| 5,992,423 | A | * | 11/1999 | Tevolini | 132/200 |
| 6,029,307 | A | * | 2/2000 | Baudoin | 15/145 |
| 6,382,216 | B1 | * | 5/2002 | Clark | 132/148 |

* cited by examiner

*Primary Examiner*—John J. Wilson
*Assistant Examiner*—Robyn Kieu Doan
(74) *Attorney, Agent, or Firm*—Fay, Sharpe, Fagan, Minnich & McKee

(57) ABSTRACT

An apparatus for the management of hair is provided. The apparatus includes a first hair management instrument, a second hair management instrument and a central connector having a first end and a second end. A first means secures the first hair management instrument to the first end of the central connector and a second means secures the second hair management instrument to the second end of the central connector.

21 Claims, 7 Drawing Sheets

14

102
100
101
16
10
14

110
105
104
108
100
103
114
112
106
16
14

122
116
120
100
118
124
126
16

APPARATUS FOR MANAGEMENT OF HAIR

BACKGROUND OF THE INVENTION

1. Field of the Invention

The present invention relates to hair care. More particularly, the present invention relates to a new apparatus for the management of hair.

2. Description of Related Art

Typically, devices for the management of hair, such as combs, brushes and the like, are separate units. Thus, when a hair care professional such as a barber or stylist needs to utilize a combination of items such as a comb and a brush, that person must use one item and set it down before picking up the next item. This may create clutter and may be difficult for a busy professional who needs to change tools often, sometimes causing the barber or stylist to drop the devices onto an unsanitized floor. These devices also pose problems for the average person who utilizes them, such as an individual who may be visually challenged. Having several separate items may create confusion with the increased clutter they cause.

In addition, typical hair management devices, particularly combs, have small handles. Thus, when a person with arthritis or a similar condition attempts to hold and use the device, it is often difficult and painful. Such small handles also present problems for professionals utilizing the tools for extended periods of time. These professionals use techniques known in the art that may be problematic with devices of the prior art. Such techniques include the clipper-over-comb and the comb-brush techniques. For example, in the clipper-over-comb technique, hair to be cut is drawn away from a customer's head by a comb which is grasped in between the forefinger and thumb of the barber or stylist. Once the portion of hair held out by the comb is cut, the comb is rotated under the next portion of hair to be cut and then rotated out so as to hold that hair away from the customer's head. This process continues for each customer until all of that customer's hair has been cut. Performing this repeated rotation of the small-handled hair management device throughout the day may cause severe discomfort.

Moreover, constant rotation of the apparatus using the forefinger and thumb becomes an awkward maneuver due to the small, flat handle types of devices of the prior art, again causing the barber or stylist to drop the tool and forcing her or him to obtain a new, sanitary one. If the barber or stylist attempts to overcome this problem by rotating the device through raising and dropping his or her wrist, such repeated wrist motion may cause pain and even problems such as carpal tunnel syndrome. Thus, problems are created by devices of the prior art through separate hair management instruments and small handle configurations that do not allow easy and firm gripping and rotation.

There have been attempts to combine hair management devices in the past. For example, U.S. Pat. No. 288,534 issued to Wilkerson discloses a comb having a solid end which forms the back of a brush. U.S. Pat. No. 2,261,747 issued to Vegh discloses a brush with a handle forming a comb. However, these devices lack the flexibility to adapt to different implements and do not allow the user to easily grip or rotate the apparatus.

Accordingly, it is desirable to develop a new apparatus for the management of hair which would overcome the foregoing difficulties by providing for the use of multiple instruments while allowing for easier grip and rotation by a user.

SUMMARY OF THE INVENTION

According to the present invention, a new apparatus for the management of hair is provided.

In accordance with an exemplary embodiment of the present invention, an apparatus for the management of hair is provided. The apparatus includes a first hair management instrument, a second hair management instrument and a central connector having a first end and a second end. A first means secures the first hair management instrument to the first end of the central connector and a second means secures the second hair management instrument to the second end of the central connector.

In accordance with another exemplary embodiment of the present invention, an apparatus for the management of hair is provided. The apparatus includes a first hair management instrument and a central connector having a first end and a second end. The first end of the central connector is connected to the first hair management instrument and a second hair management instrument is removably connected to the second end of the central connector.

In accordance with yet another exemplary embodiment of the present invention, an apparatus for the management of hair is provided. The apparatus includes a first hair care instrument including a proximal end, a handle near the proximal end, an interface edge on the handle, a shaft connected to the handle at the interface edge and a base having an upper surface and defining an orifice in its cross-section. The shaft removably engages the orifice and bristles are secured to the upper surface of the base. A connector has a first end and a second end and the first end of the connector is secured to the proximal end of the first hair care instrument.

The benefits and advantages of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE PREFERRED EMBODIMENTS

Figure 1:
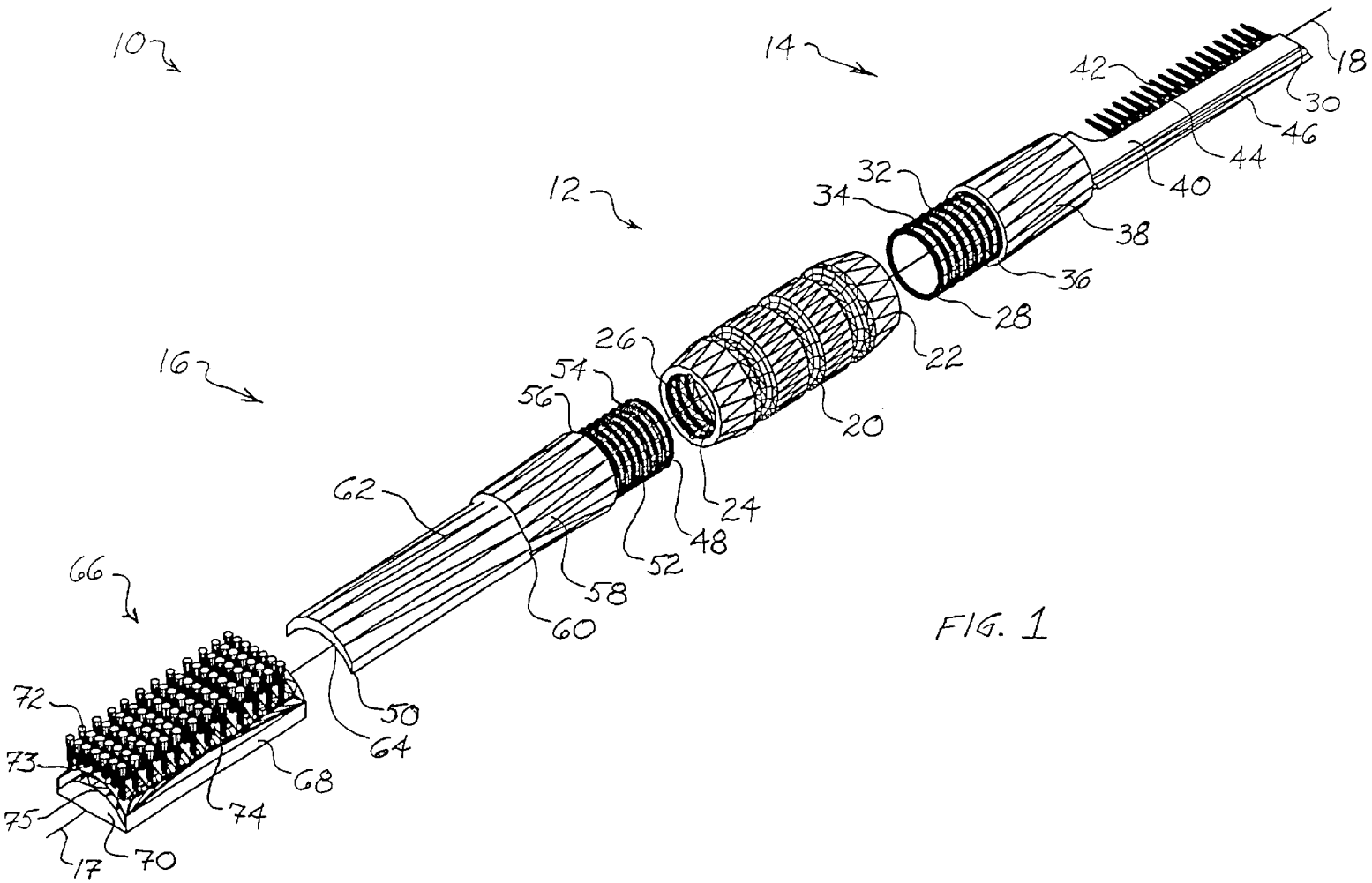
FIG. 1 is an exploded perspective view of an apparatus for the management of hair in accordance with a first embodiment of the present invention.

Referring now to the drawings, wherein the showings are for purposes of illustrating preferred embodiments of the invention only and not for purposes of limiting the same, FIG. 1 shows the components of an apparatus for the management of hair in accordance with a first embodiment of the present invention. An apparatus 10 comprises a central connector 12 that couples a first hair management instrument 14 and a second hair management instrument 16 along a longitudinal axis 18. In the illustrated embodiment, the central connector 12 has a cylindrical configuration and the first instrument 14 is a comb and the second instrument 16 is a bristle brush. An enhanced grip surface 20 is defined by the central connector 12.

Means to facilitate the coupling of the first instrument 14 and the second instrument 16 into a single apparatus 10 may include a first orifice 22 and a second orifice 24 that are defined at opposing first and second ends of the central connector 12. Such coupling will be described in greater detail below and may be accomplished by any means known in the art, including pin and orifice, threaded members, snap-fit, interference type fittings, and the like. In the illustrated embodiment, the central connector 12 includes threads 26 in both the first orifice 22 and the second orifice 24.

The first hair management instrument 14 comprises a proximal end 28 and a distal end 30, with the proximal end having a cross-section compatible with the first orifice 22 of the central connector 12. An interlocking portion 32 is adjacent the proximal end 28 and contains interlocking members 34, such as threads, that are compatible with the threads 26 of the central connector 12. The first orifice 22 defined by the central connector 12 may receivably engage the interlocking portion 32, as shown, or the first instrument 14 may define an orifice to receive an interlocking portion of the central connector 12. In the illustrated embodiment, the interlocking members 34 terminate at a shoulder 36 which contacts the central connector 12 in an assembled state. As mentioned above, other connecting means known in the art, such as a pin, a snap-fit or an interference fit, may be used to create a removable coupling.

Proximate the interlocking portion 32 of the first instrument 14 is an upper handle 38. The upper handle 38 may define a textured surface which, as will be described below, may comprise a portion of an enhanced grip surface 20. A first implement 40 extends from the upper handle 38. In the illustrated embodiment, the first implement 40 is a comb. The comb 40 includes teeth 42 and a first edge 44 at the base of the teeth. A second edge 46, sometimes referred to as a spine, can extend parallel to the first edge 44. The second edge 46 may also be non-parallel to the first edge 44, tapering to a generally pointed configuration at the distal end 30.

The second hair management instrument 16 comprises a proximal end 48 and a distal end 50, and an interlocking portion 52 adjacent the proximal end 48. The interlocking portion 52 includes interlocking members 54, shown as threads that are compatible with the threads 26 of the central connector 12. As mentioned above, other connecting means known in the art, such as a pin, snap-fit or interference fit, may be used to create a removable coupling. The interlocking members 54 terminate at a shoulder 56 which contacts the central connector 12 in an assembled state. The second orifice 24 defined by the central connector 12 may receivably engage the interlocking portion 52, as shown, or the second instrument 16 may define an orifice to receive an interlocking portion of the central connector 12.

Proximate the interlocking portion 52 is an upper handle 58 of the second instrument 16. The upper handle 58 may define a textured surface which, as will be described below, may comprise a portion of an enhanced grip surface 20. The upper handle 58 includes an interface edge 60 to which a shaft 62 connects. The shaft 62 may be straight or may taper along the longitudinal axis 18, as desired. In addition, the cross-sectional configuration 64 of the shaft 62 may be curved, as shown, or may take other geometric configurations.

A second implement 66 may be removably engaged with the shaft 62 of the second instrument 16. In the illustrated embodiment, the second implement 66 is a bristle brush. The second implement 66 has a base 68 and a cross-sectional configuration defining an orifice 70 which engages the shaft 62, thus allowing the shaft to removably engage the base 68. Bristles 72 are secured as known in the art to an upper surface 73 of the base 68 of the second implement 66. The upper surface 73 defines a multiplicity of orifices 74 in between the bristles 72 to allow items such as dander and small particles of hair to pass through the bristles to an inner plate 75, rather than remaining on the upper surface 73 near the bristles 72 like devices of the prior art. In practice, dander and similar particles that are present in the hair or on the scalp of a person are picked up by bristles 72 and pass through the orifices 74. Instead of trapping these particles in the brush and creating a need to sanitize the entire unit, as with devices of the prior art, the present invention allows the bristle implement 66 to be removed from the shaft 62 and sanitized. A clean bristle implement 66 may then be placed on the shaft 62, creating a more sanitary environment without the need for multiple separate brush assemblies.

Thus, the present invention provides for more sanitary instruments and the easy and secure connection of two hair management instruments 14 and 16. As illustrated, the instruments 14 and 16 may both be removably coupled or only one may be removably coupled to the central connector 12. In addition, both the first instrument 14 and the second instrument 16 may be permanently coupled or manufactured as a single unit. If the present invention comprises permanently coupled instruments, the interchangeability of instruments by a user, to be described below, may not be present. Moreover, while the illustrated embodiment depicts the first instrument 14 as a comb and a second instrument 16 as a bristle brush, the present invention may utilize various other types of hair management instruments, also to be described below.

Figure 2:
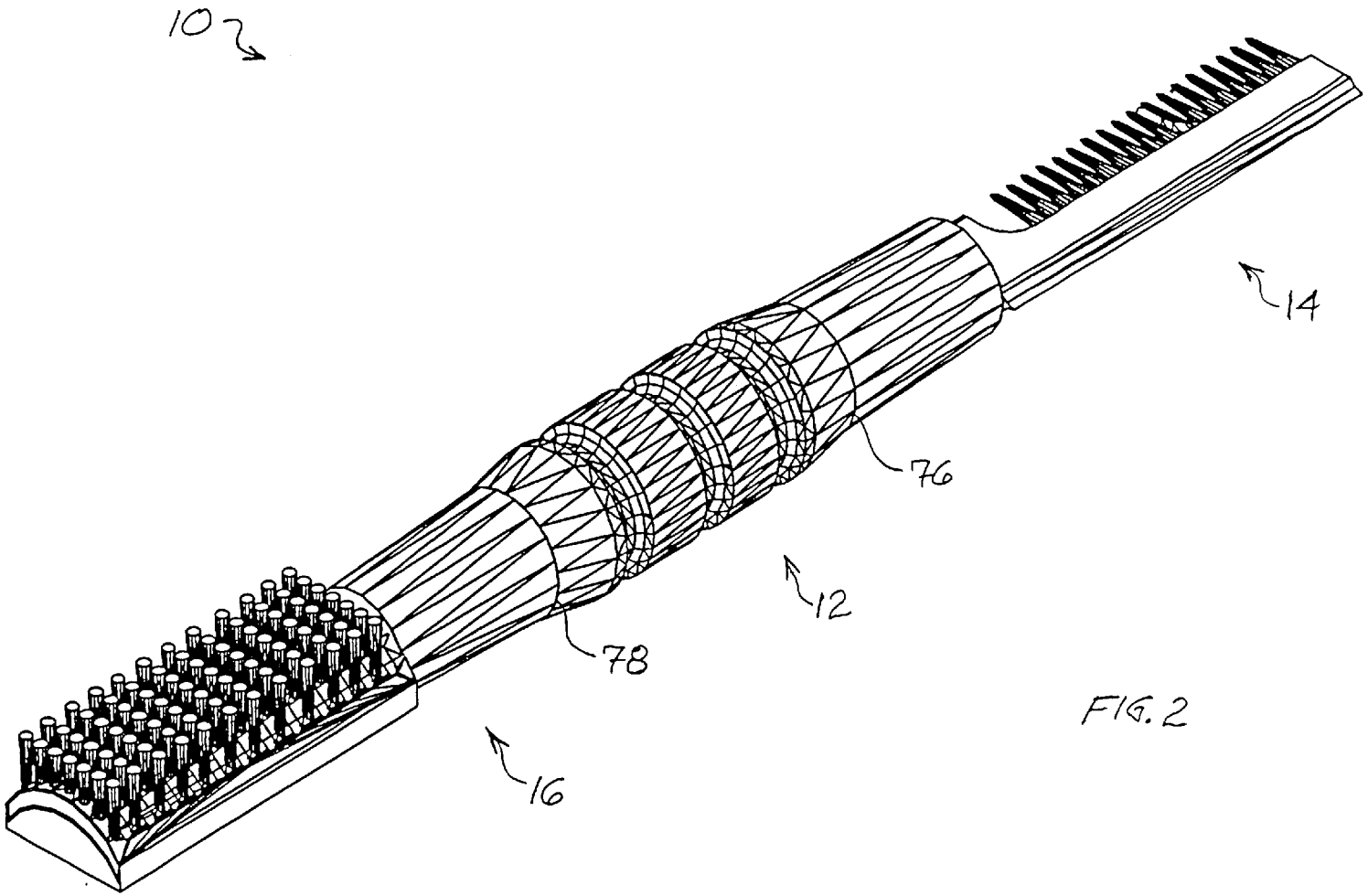
FIG. 2 is an assembled perspective view of the apparatus illustrated in FIG. 1.

Turning now to FIG. 2, the apparatus for the management of hair 10 is shown in an assembled state, with the first instrument 14 and the second instrument 16 coupled by the central connector 12. In an assembled state, a mating line 76 delineates the visible area of connection between the first hair management instrument 14 and the central connector 12, while a second mating line 78 delineates the visual area of connection between the second hair management instrument and the central connector 12. Of course, if the apparatus is manufactured with one or both instruments 12 and 14 permanently coupled, one or both of the mating lines 76 and 78 may not be present.

Figure 3:
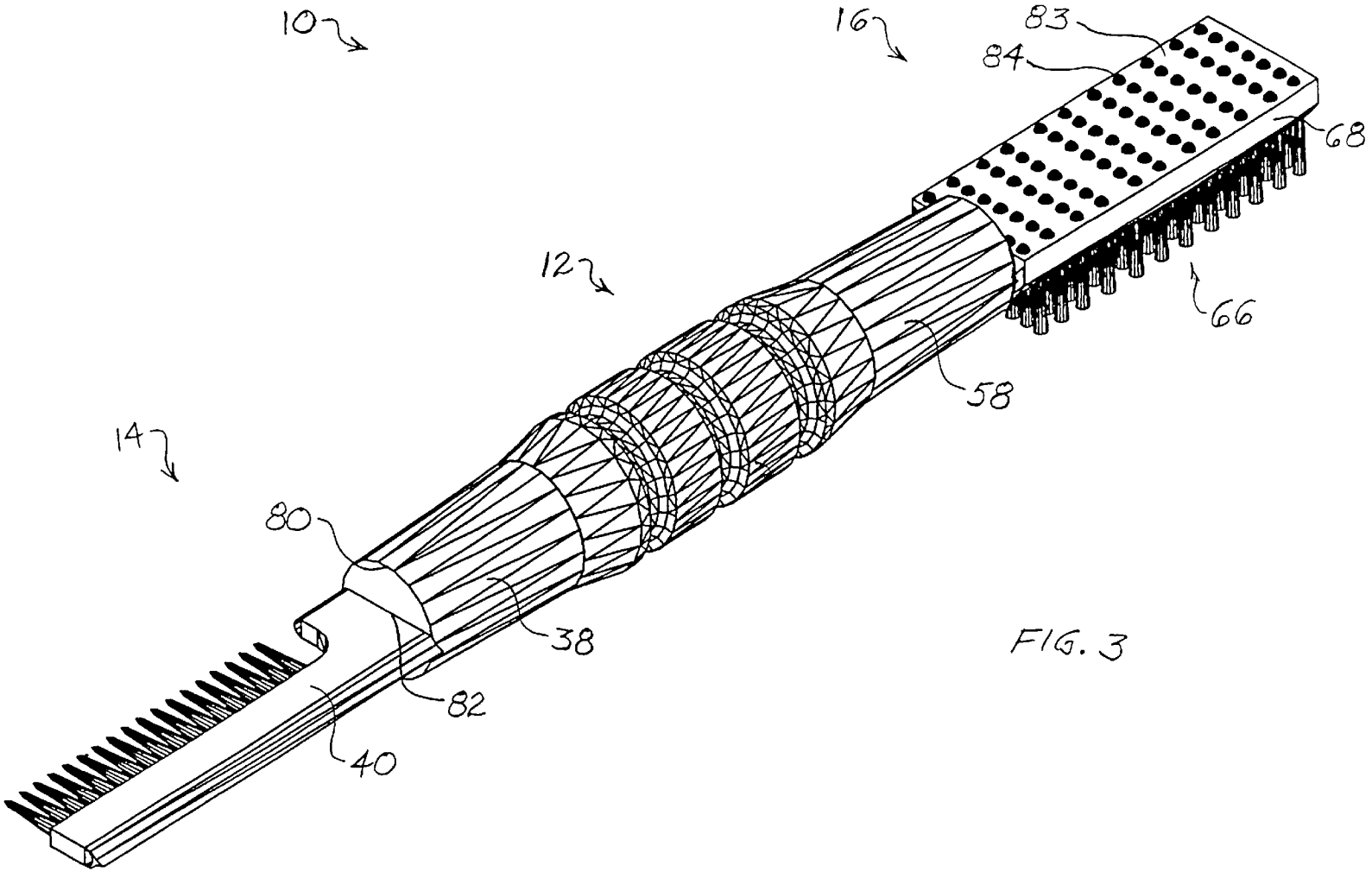
FIG. 3 is an assembled perspective view of the apparatus illustrated in FIG. 1 from a reverse angle.

Referring to FIG. 3, the apparatus for the management of hair 10 is shown from a reverse perspective view. In this view, a transition point 80 is shown on the first hair management instrument 14 between the upper handle 38 and the first implement 40. The transition point 80 defines a surface for the point of attachment 82 of the first implement 40 to the upper handle 38. The attachment of the first implement 40 at point 82 may be by standard means known in the art such as mechanical fasteners, a snap-fit or chemical bonding. In addition, the first implement 40 and the upper handle 38 may be an integrally molded assembly.

With continuing reference to FIG. 3, the base 68 of the second implement 66 of the second hair management instrument 16 includes a lower surface 83. The lower surface 83 defines finger placement points 84 which may assist the user of the apparatus 10 in gripping the apparatus 10 in a stable manner by allowing one or more fingers (including a thumb) to be placed on slip resistant placement points 84.

Figure 4:
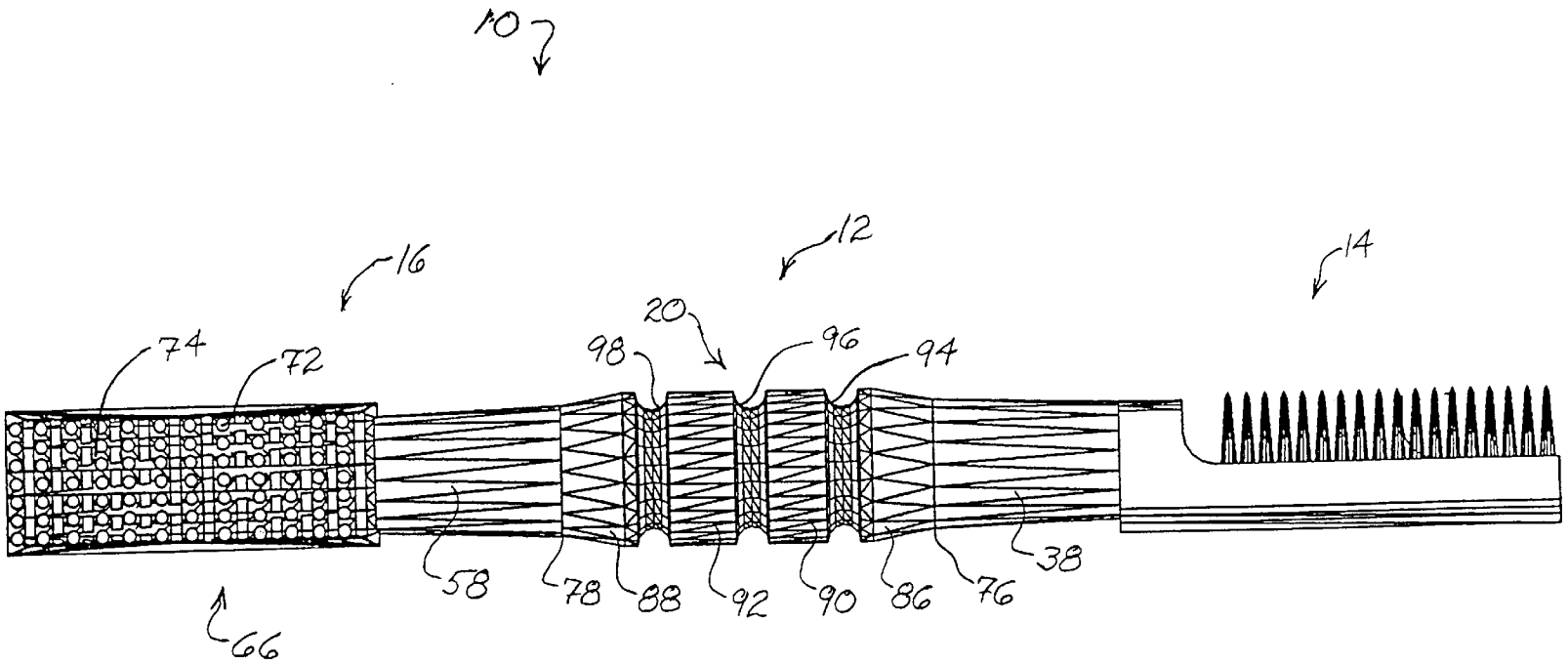
FIG. 4 is an assembled top view of the apparatus illustrated in FIG. 1.

Turning to FIG. 4, the orifices 74 defined in between bristles 72 on the second implement 66 are illustrated. Also shown in FIG. 4 are the details of an embodiment of the central connector 12 and the enhanced grip surface 20. The central connector 12 includes a first end 86 and a second end 88. In between the first end 86 and the second end 88 is at least one central body member. In the illustrated embodiment, two central body members are shown, a first central body member 90 and a second central body member 92. A first groove 94 is defined in the circumference of the central connector 12 between the first end 86 and the first central body member 90. While different numbers of grooves may be present, the illustrated embodiment depicts three grooves, the first groove 94, a second groove 96 defined between the first central body member 90 and the second central body member 92 and a third circumferential groove 98 defined between the second central body member 92 and the second end 88. The width and the depth of each groove 94, 96 and 98 are defined to allow a user to place a finger over a groove or in a portion of a groove. This allows a user to have an indexing means for the initial placement of his or her fingers and a guide for rotating the apparatus 10 uniformly.

The enhanced grip surface 20 may also include texturing the surface of the central connector 12 and at least one of the upper handles 38 and 58 of the instruments 14 and 16. This surface texturing enhances the ability of the apparatus 10 to be gripped by a user. The texturing also facilitates an enhanced tactile response by the apparatus 10 to a rotating motion made by a user. The tactile response generated by the enhanced grip surface 20 is advantageous in many ways. A busy professional is able to focus on the customer, rather than the instrument, by knowing the exact position of the instrument through tactile means. The professional is also easily able to switch from the first implement 14 to the second implement 16 and back, as both are part of the same apparatus and have the enhanced grip surface 20 to allow easy indexing and maneuvering. In addition, an average user would be able to pick up and use the apparatus 10 more easily because of the enhanced surface. The present invention also lends particular advantage to people with impaired or no vision. The enhanced grip surface 20 allows the person to locate the proper grip position through touch alone and provides for the use of multiple tools in one unit. Thus, a person with reduced or no vision may use a single, easily indexed apparatus 10 in place of multiple, difficult-to-orient tools of the prior art.

The central member 12 is of an outer diameter between about 0.5 inches and 2.0 inches to allow a user to easily grasp and hold the connector 12. Many advantageous grasp configurations are possible. For example, a user may place a portion of his or her index finger over groove 94, a portion of his or her middle finger over groove 96, a portion of his or her ring finger over groove 98 and a portion of his or her thumb over groove 94 opposite the portion occupied by the index finger. Through a slight back and forth motion of the fingers, the entire apparatus 10 rotates about its longitudinal axis 18 (referring back to FIG. 1), thereby facilitating easy rotation of angles well over 90°. Such rotation may even be accomplished through the use of only two fingers rather than the four previously described. Finger placement for users may vary depending upon personal preferences. Thus, some users may choose to place a portion of a thumb or an index finger on the upper handle 38 or 58 during certain uses of the apparatus 10 and may place some fingers on the upper handle 58 and the finger placement points 84 (referring back to FIG. 3) when using the second instrument portion 16. Many other grip positions are possible, as the above positions are provided for purposes of illustration only.

Other shapes may be used for the central connector. For example, turning now to FIGS. 5–7, an alternative configuration for a central connector 100 is shown. The central connector 100 is essentially flat with contoured sides, having a first top side 101 extending in a generally parallel manner to an opposing second bottom side 102. A third side 103 and a fourth side 104 are located opposite each other and connect the first side 101 and the second side 102. The central connector 100 has a first end 105 and a second end 106. A contoured portion 108, 110 is defined on both the third side 103 and the fourth side 104, respectively. The contoured portion 108, 110 near the first end 105 acts as a main finger grip area and may include a textured surface or a soft material to allow enhanced gripping by a user. The shape of the entire central connector 100 is thus generally flat with two contoured sides.

An additional contoured portion 112, 114 may be included on the central connector 100 or on a portion of either or both hair care instruments 14 and 16 proximate the central connector 100. This allows a user to place additional fingers in a compressive position and thereby increase control and responsiveness of the apparatus 10 with minimal effort. As with the contoured portion of the central connector 108, 110 the additional contoured portion 112, 114 may include a texture or a soft material to facilitate gripping.

Figures 5, 6, 7:
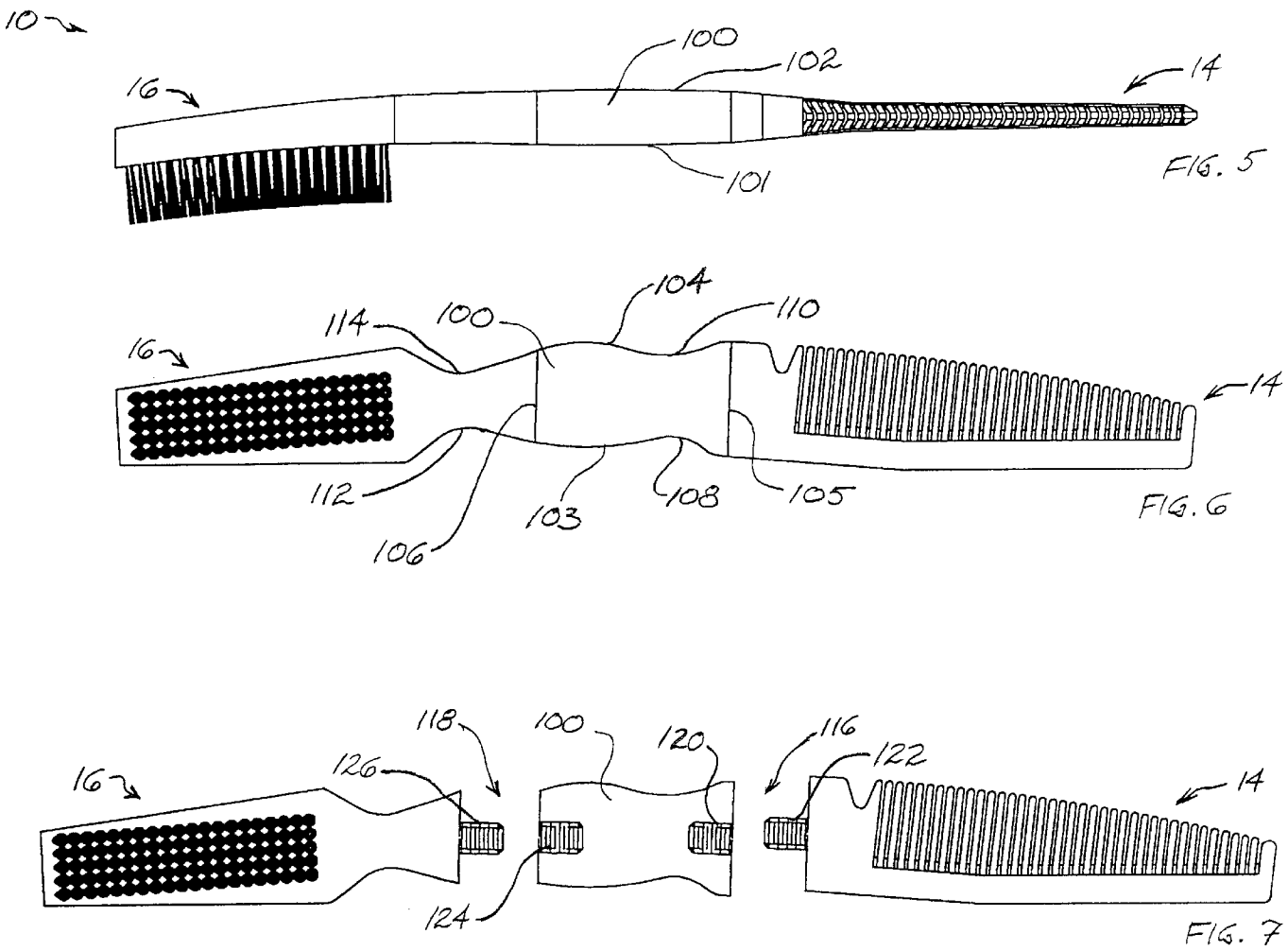
FIG. 5 is an assembled side view of an apparatus for the management of hair in accordance with a second embodiment of the present invention.
FIG. 6 is an assembled top view of the apparatus illustrated in FIG. 5.
FIG. 7 is an exploded top view of the apparatus illustrated in FIG. 5.

FIG. 7 illustrates coupling means, such as a first threaded connection 116 between the central connector 110 and the first hair care instrument 14 and a second threaded connection 118 between the central connector 100 and the second hair care instrument 16. The central connector 100 defines a first threaded orifice 120 that receives a first threaded rod 122 located on the first hair care instrument 14. The central connector 100 also defines a second threaded orifice 124 that receives a second threaded rod 126 located on the second hair care instrument. It is to be noted that any means of coupling known in the art, including those noted above, may be used to connect the central connector 100 to either or both the first hair care instrument and the second hair care instrument.

The central connector 100 may be an integral part of at least one of the first hair care instrument 14 and the second hair care instrument 16. For example, the central connector 100 may be permanently attached to the second hair care instrument 16. Or, one portion of the central connector 100 may be part of the first hair care instrument 14 and a second portion may be part of the second hair care instrument 16, resulting in the formation of a complete central connector 100 upon assembly of the unit 10.

Figure 8:
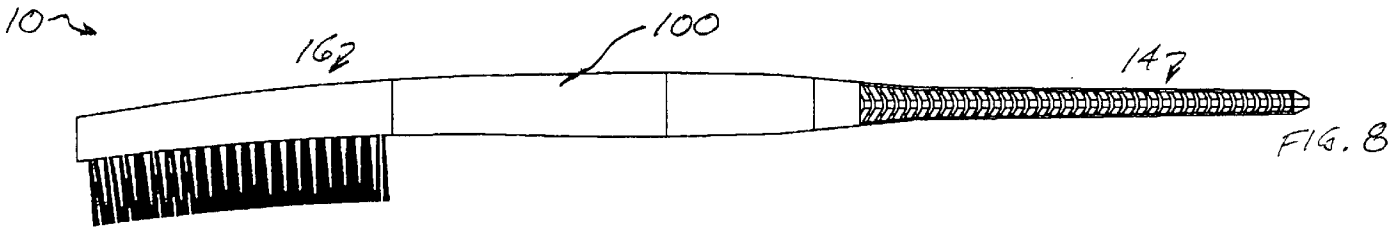
FIG. 8 is an assembled side view of an apparatus for the management of hair in accordance with a third embodiment of the present invention.
Figure 9:
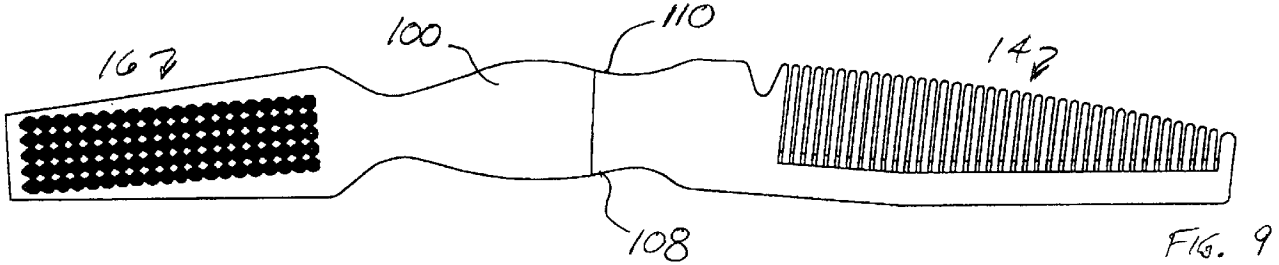
FIG. 9 an assembled top view of the apparatus illustrated in FIG. 8.
Figure 10:
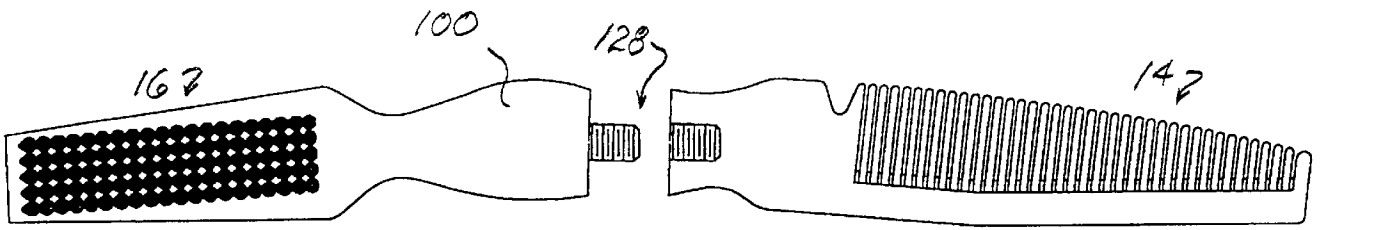
FIG. 10 an exploded top view of the apparatus illustrated in FIG. 8.

In FIGS. 8–10, the apparatus 10 is illustrated as a two-piece unit, wherein the central connector 100 is shown as an integral part of the second hair care instrument 16 and the first hair care instrument 14 is attached thereto at a connection 128, shown as a threaded connection. In the illustrated embodiment, the contoured portion 108, 110 extends from the central connector 100 across an adjacent portion of the first hair care instrument 14. Any coupling means known in the art, as described above, may be used to facilitate the connection 128.

In addition to a three-piece unit (FIG. 7) and a two-piece unit (FIG. 10), the apparatus 10 may be a one-piece unit wherein the central connector 100, first hair care instrument 14, and the second hair care instrument 16 are not removably coupled.

The shape of the central connector shown in FIGS. 5–10 allows ease of use and the incorporation of two hair management instruments similar to that of the previously described embodiments. For example, a user may place a portion of an index finger and a thumb on opposing sides of the contoured portions 108, 110 and a pinky finger on the additional contoured portion 112, 114 to easily maneuver and rotate the apparatus 10 with the use of only a few fingers. It is anticipated that a user will easily be able to rotate the apparatus well over 90° about a longitudinal axis 18 (referring back to FIG. 1) through the use of only two fingers. The previously described removable second implement 66 (referring back to FIG. 1), may be utilized in these embodiments as well.

The distance between the opposing contoured portions 108 and 110 of the central connector 100 is between about 0.5 inches and 2.0 inches. Thus, with both this connector and the embodiment described above, a user may easily grip the apparatus. This is convenient for both home users and professionals and may help to reduce the discomfort of professionals who typically grasp hair care instruments for long periods. In addition, the large size and tactile surface allow users with conditions such as arthritis to grasp and manipulate the apparatus of the present invention much more easily and with less pain than devices of the prior art. As mentioned, other shapes that provide enhanced gripping by a user may be used for the central connector.

Figure 11:
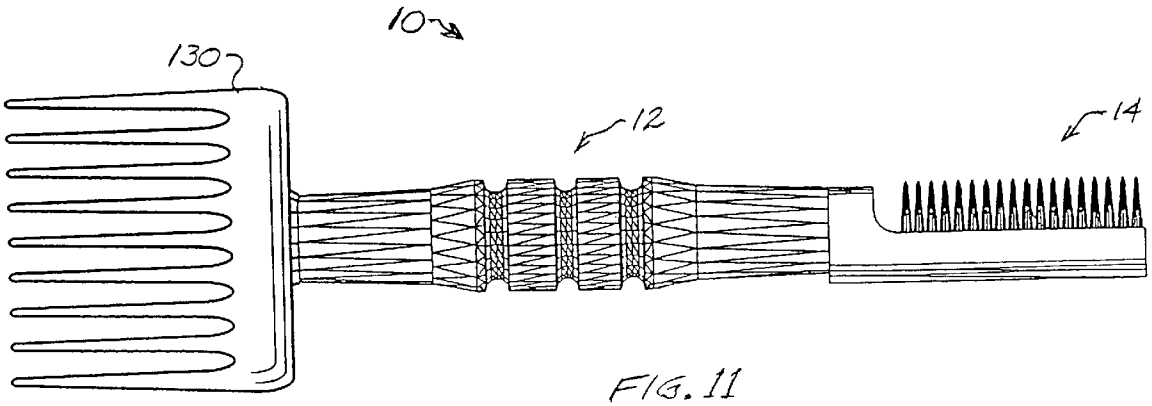
FIG. 11 is an assembled top view of an apparatus for the management of hair in accordance with a fourth embodiment of the present invention.
Figure 12:
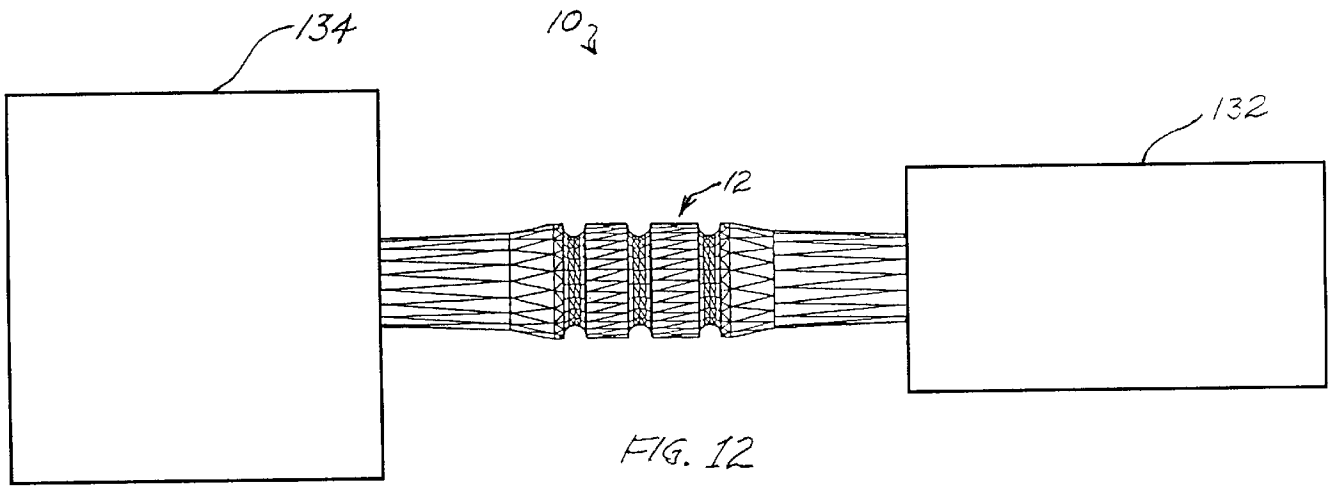
FIG. 12 is an assembled top view of an apparatus for the management of hair in accordance with a fifth embodiment of the present invention.

Turning to FIGS. 11 and 12, many different hair management instruments may be used in the apparatus 10 of the present invention. For example, as described above, a comb and a bristle brush may be used. Other instruments such as a hair pick 130, shown in FIG. 11, may be used. As FIG. 12 illustrates, various tools known in the art may be adapted for use with the central connector 12, taking the general location of one or both of the symbolic boxes 132 and 134. These tools may include, in addition to those previously described, a single rod tail pick, a clipper attachment, a hair color bottle, a hot comb, a beard comb, a moustache comb and other specialized combs and tools. The specific tool configuration that is used may depend on the particular hair care service that is to be performed, hence making performance of that specific hair care service easier.

Thus, the present invention provides for an apparatus which may be designed to have two different tools permanently attached to one another with an ergonomic handle, i.e., a central connector, or two different tools removably coupled as a two-piece (one instrument and at least a portion of a central connector removably coupled to a second instrument) or a three-piece (two separate instruments both removably coupled to a central connector) apparatus. As a result, there is tremendous flexibility for both home users and for professionals. For example, professionals could have multiple instruments of the same type, such as a comb, may place many combs in a sterilizing medium while one comb is in use. When a new customer is to be serviced, a clean comb may easily be placed on the central connector 12.

Moreover, the entire apparatus 10 could be changed for each customer, not only for sanitary reasons, but depending on the instruments needed for each customer, as mentioned above. For example, for some individual styles of hair, a comb instrument and a bristle brush instrument may be optimal. However, for others, a comb and a hair pick may provide the best combination. Other tools may be selected from the list above or from any other instruments typically used for hair care. This interchangeability and easy-to-grip surface, combined with the ergonomic shape of the apparatus 10, provides many advantages for professionals, including greater versatility (with a tool that can be configured for each customer), increased comfort and increased ability to maneuver the apparatus 10 for hair styling techniques.

Home users may also benefit from the advantage of multiple tools given by the present invention. A person could use a single apparatus having two tools, reducing the amount of clutter, and may also be able to exchange multiple tools on the same apparatus. While a comb and a brush may work best at one point, a comb and a fine-toothed moustache comb may be preferred by the user at another point. For a visually impaired person, the use of one multi-instrument apparatus rather than multiple separate items of the prior art is much more convenient. Thus, the present invention allows for multiple advantages to many types of users of hair management devices.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the invention, I claim:

1. An apparatus for the management of hair, comprising:

a first hair management instrument;

a second hair management instrument;

a central connector having a first end and a second end;

a first means for removably securing said first hair management instrument to said first end of said central connector;

a second means for removably securing said second hair management instrument to said second end of said central connector; and at least one of said first and second hair management instruments comprises a shaft and a selectively removable base, said base including an orifice in its cross-section, wherein said shaft removably engages said orifice.

2. The apparatus for management of hair of claim 1, wherein at least one of said first and second hair management instruments comprises a comb.

3. The apparatus for management of hair of claim 1, wherein at least one of said first and second hair management instruments comprises a brush.

4. The apparatus for management of hair of claim 1, wherein at least one of said first and second hair management instruments is selected from the group consisting of a hair pick, a beard comb, a moustache comb, a single rod tail pick, a clipper attachment, a hot comb and a hair color bottle.

5. The apparatus for management of hair of claim 1, wherein said central connector includes a cylindrical body and defines at least one circumferential groove.

6. The apparatus for management of hair of claim 1, wherein said central connector includes a first side extending parallel to an opposing second side, a third side and a fourth side extending opposite each other and connecting said first and second sides, and said first side and said second side each defining at least a part of a contoured portion.

7. An apparatus for the management of hair, comprising:

a first hair management instrument;

a second hair management instrument;

a central connector having a first end and a second end;

a first means for removably securing said first hair management instrument to said fist end of said central connector;

a second means for removably securing said second hair management instrument to said second end of said central connector;

at least one of said first and second hair management instruments comprises a brush;

a shaft;

a base having an upper surface and defining an orifice in its cross-section, wherein said shaft removably engages said orifice; and bristles secured to said upper surface of said base.

8. An apparatus for the management of hair, comprising:

a first hair management instrument;

a central connector having a first end and a second end, wherein said first end is removably connected to said first hair management instrument;

a second hair management instrument removably connected to said second end of said central connector;

said second hair management instrument outwardly extending from said second end when said second hair management instrument connected to said second end; and at least one of said first and second hair management instruments comprises a shaft and a selectively romovable base, said base including an orifice in its cross-section, wherein said shaft removably engages said orifice.

9. The apparatus for management of hair of claim 8, wherein said connection between said first end of said connector and said first hair management instrument is permanent.

10. The apparatus for management of hair of claim 8, wherein at least one of said first and second hair management instruments comprises a comb.

11. The apparatus for management of hair of claim 8, wherein at least one of said first and second hair management instruments comprises a brush.

12. The apparatus for management of hair of claim 8, wherein at least one of said first and second hair management instruments is selected from the group consisting of a hair pick, a beard comb, a moustache comb, a single rod tail pick, a clipper attachment, a hot comb and a hair color bottle.

13. The apparatus for management of hair of claim 8, wherein said central connector includes a cylindrical body and defines at least one circumferential groove.

14. The apparatus for management of hair of claim 8, wherein said central connector includes a first side extending parallel to an opposing second side, a third side and a fourth side extending opposite each other connecting said first and second sides, and said first side and said second side each defining at least a part of a contoured portion.

15. An apparatus for the management of hair, comprising:

a first hair management instrument;

a central connector having a first end and a second end, wherein said first end is connected to said first hair management instrument;

a second hair management instrument removably connected to said second end of said central connector; and, said second hair management instrument outwardly extending from said second end when said second hair management instrument connected to said second end;

at least one of said first and second hair management instruments comprises a brush;

a shaft;

a base having an upper surface and defining an orifice in its cross-section, wherein said shaft removably engages said orifice; and bristles secured to said upper surface of said base.

16. An apparatus for the management of hair, comprising:

a first hair care instrument including a proximal end, a handle near said proximal end, an interface edge on said handle, a shaft connected to said handle at said interface edge, a base having an upper surface and defining an orifice in its cross-section, wherein said shaft removably engages said orifice, and bristles secured to said upper surface of said base;

a rigid connector having a first end and a second end, wherein said first end of said connector is secured to said proximal end of said first hair care instrument;

said connector axially aligned with said first hair care instrument; and a second hair care instrument secured to said second end of said connector.

17. An apparatus for the management of hair, comprising:

a first hair care instrument including a proximal end, a handle near said proximal end, an interface edge on said handle, a shaft connected to said handle at said interface edge, a base having an upper surface and defining an orifice in its cross-section, wherein said shaft removably engages said orifice, and bristles secured to said upper surface of said base; and, a connector having a first end and a second end, wherein said first end of said connector is secured to said proximal end of said first hair care instrument; and, a second hair care instrument secured to said second end of said connector.

18. An apparatus for the management of hair, comprising:

a first hair care instrument including a proximal end, a handle near said proximal end, an interface edge on said handle, a shaft connected to said handle at said interface edge, a base having an upper surface and defining an orifice in its cross-section, wherein said shaft removably engages said orifice, and bristles scoured to said upper surface of said base; and, a connector having a first end and a second end, wherein said first end of said connector is secured to said proximal end of said first hair care instrument;

a second hair care instrument secured to said second end of said connector; and, at least one of said first and second hair care instruments is removably secured to said connector.

19. An apparatus for the management of hair, comprising:

a first hair management instrument;

a second hair management instrument;

a central connector having a first end and a second end;

said first hair management instrument, said second hair management instrument, and said central connector defining a longitudinal axis;

a mechanism to secure said first hair management instrument to said first end of said central connector along said axis;

a mechanism to secure said second hair management instrument to said second end of said central connector along said axis; and, at least one of said first and second hair management instruments comprises a shaft and a selectively removable base, said base including an orifice in its cross-section, wherein said shaft removably engages said orifice.

20. The apparatus for management of hair of claim 19, wherein said first hair management instrument outwardly extending from said first end of said central connector and said second hair management instrument outwardly extending from said second end of said central connector.

21. The apparatus for management of hair of claim 19, wherein at least one of said first and second hair management instruments includes a base having an upper surface, said upper surface includes a plurality of orifices therethrough.

* * * * *